US006196044B1

(12) United States Patent
Sofy

(10) Patent No.: US 6,196,044 B1
(45) Date of Patent: Mar. 6, 2001

(54) PRESS TRANSFER BAR-FINGER SUPPORT

(75) Inventor: Hugh Sofy, Troy, MI (US)

(73) Assignee: HMS Products Co., Troy, MI (US)

( * ) Notice: Subject to any disclaimer, the term of this patent is extended or adjusted under 35 U.S.C. 154(b) by 0 days.

(21) Appl. No.: 09/443,585

(22) Filed: Nov. 19, 1999

(51) Int. Cl.[7] ..... B21D 43/05
(52) U.S. Cl. ..... 72/405.13; 72/405.01
(58) Field of Search ..... 72/405.13, 405.16, 72/405.12, 405.11, 405.09, 405.01

(56) References Cited

U.S. PATENT DOCUMENTS

| | | | | |
|---|---|---|---|---|
| 4,852,381 | | 8/1989 | Sofy | 72/405 |
| 4,895,013 | | 1/1990 | Sofy | 72/405 |
| 5,074,141 | * | 12/1991 | Takeuchi | 72/405.13 |
| 5,771,561 | * | 6/1998 | Hofele | 72/405.13 |

FOREIGN PATENT DOCUMENTS

| | | | | |
|---|---|---|---|---|
| 277589 | * | 4/1990 | (DE) | 72/405.01 |
| 559991 | * | 9/1993 | (EP) | 72/405.09 |
| 64-40126 | * | 2/1989 | (JP) | 72/405.13 |

* cited by examiner

*Primary Examiner*—Daniel C. Crane
(74) *Attorney, Agent, or Firm*—Howard & Howard

(57) ABSTRACT

A mounting plate (16) for attaching a finger (14) to extend in a cantilevered fashion from a transfer bar (12) in a work piece transfer assembly for a press including a reciprocating member and a series of longitudinally spaced in-line stations wherein each station is a further progression of a work piece forming process. The finger (14) includes a shank (18) and the mounting plate (16) includes a groove (22) for engaging the sides of the shank (18) to prevent the shank (18) from rotating relative to the mounting plate (16). A shank fastener (24) extends downwardly through the transfer bar (12) and the mounting plate (16) to threadedly engage the shank (18) and sandwich the mounting plate (16) between the shank (18) and the transfer bar (12).The mounting plate (16) is L-shaped with a first leg (32) for being sandwiched between the bottom of the transfer bar (12) and the shank (18) and with a second leg (34) for engaging the side of the transfer bar (12). A pair of plate fasteners (36) threadedly engage the top of the T-shaped second leg (34) and the groove (22) is disposed in the bottom of the T-shaped second leg (34).

16 Claims, 3 Drawing Sheets

PRESS TRANSFER BAR-FINGER SUPPORT

BACKGROUND OF THE INVENTION

1. Field of the Invention

The subject invention relates to work piece transfer assembly for a press including a reciprocating member and a series of longitudinally spaced in-line stations wherein each station is a further progression of a work piece forming process and, more specifically, to a mounting system for a finger which engages and moves the work piece.

2. Description of the Prior Art

Such work piece transfer assemblies usually include a transfer bar and a motion transmitting mechanism for moving the bar inward, outward, and longitudinally for transferring work pieces through the press. A finger is attached to the transfer bar for engaging and transferring work pieces through the press. Typical prior art assemblies are disclosed in U.S. Pat. No. 4,833,908 to Sofy et al; U.S. Pat. No. 4,852,381 and U.S. Pat. No. 4,895,013, both to Sofy, the inventor herein, and U.S. Pat. No. 5,074,141 to Takeuchi.

An objective in the construction of such fingers is that they provide the requisite strength yet remain light in weight.

SUMMARY OF THE INVENTION AND ADVANTAGES

Accordingly, the subject invention provides the requisite strength and light in weight. The invention is implemented in a work piece transfer assembly for a press including a reciprocating member and a series of longitudinally spaced in-line stations wherein each station is a further progression of a work piece forming process. The assembly in which the invention is implemented comprises a transfer bar, a motion transmitting mechanism for moving the bar inward, outward, and longitudinally for transferring work pieces through the press, and a finger for attachment to the transfer bar for engaging and transferring work pieces through the press. The assembly is characterized by a mounting plate for attaching the finger to the transfer bar to extend in a cantilevered fashion to a distal end.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
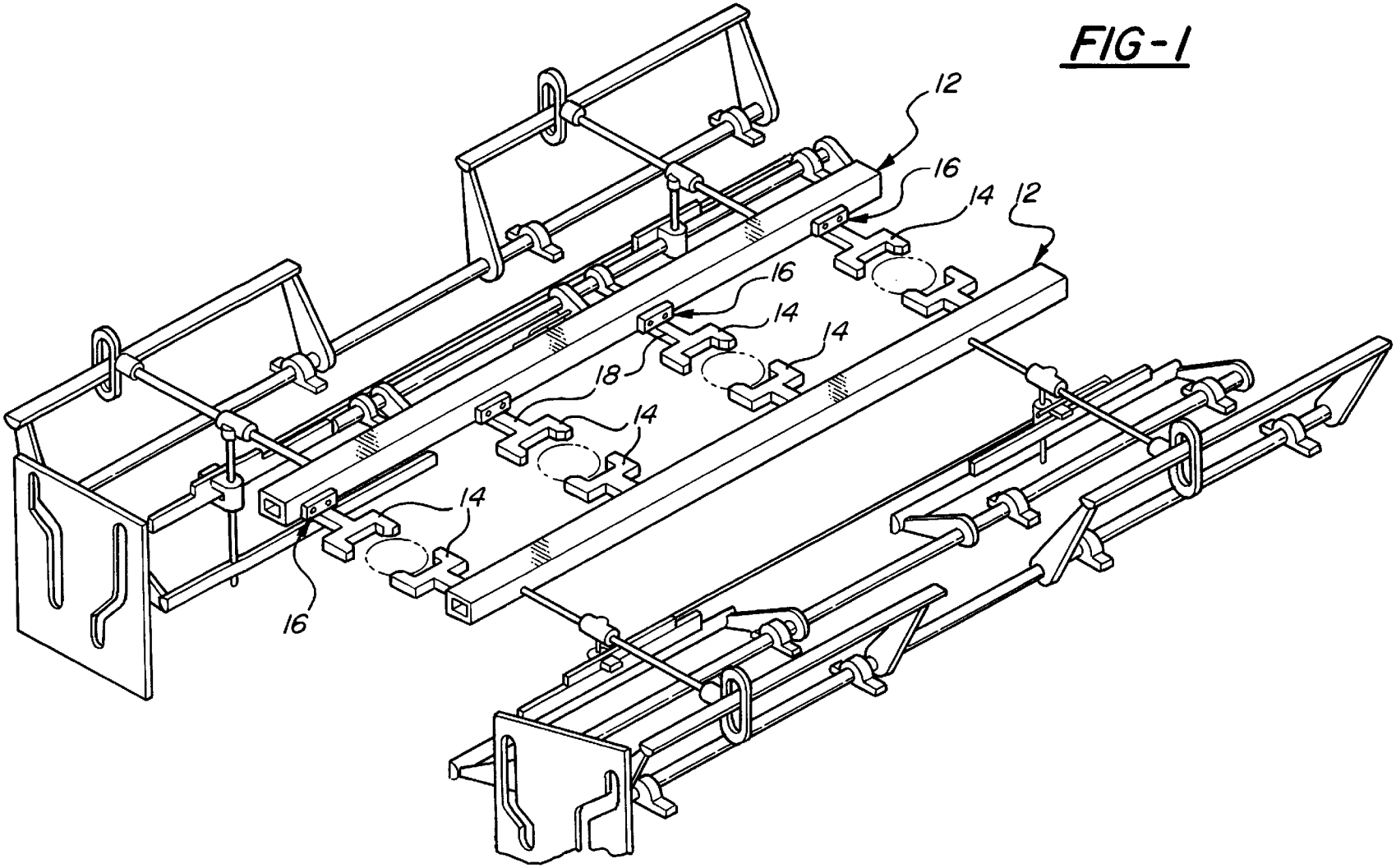
FIG. 1 is a perspective view of a transfer mechanism including the subject invention.
Figure 2:
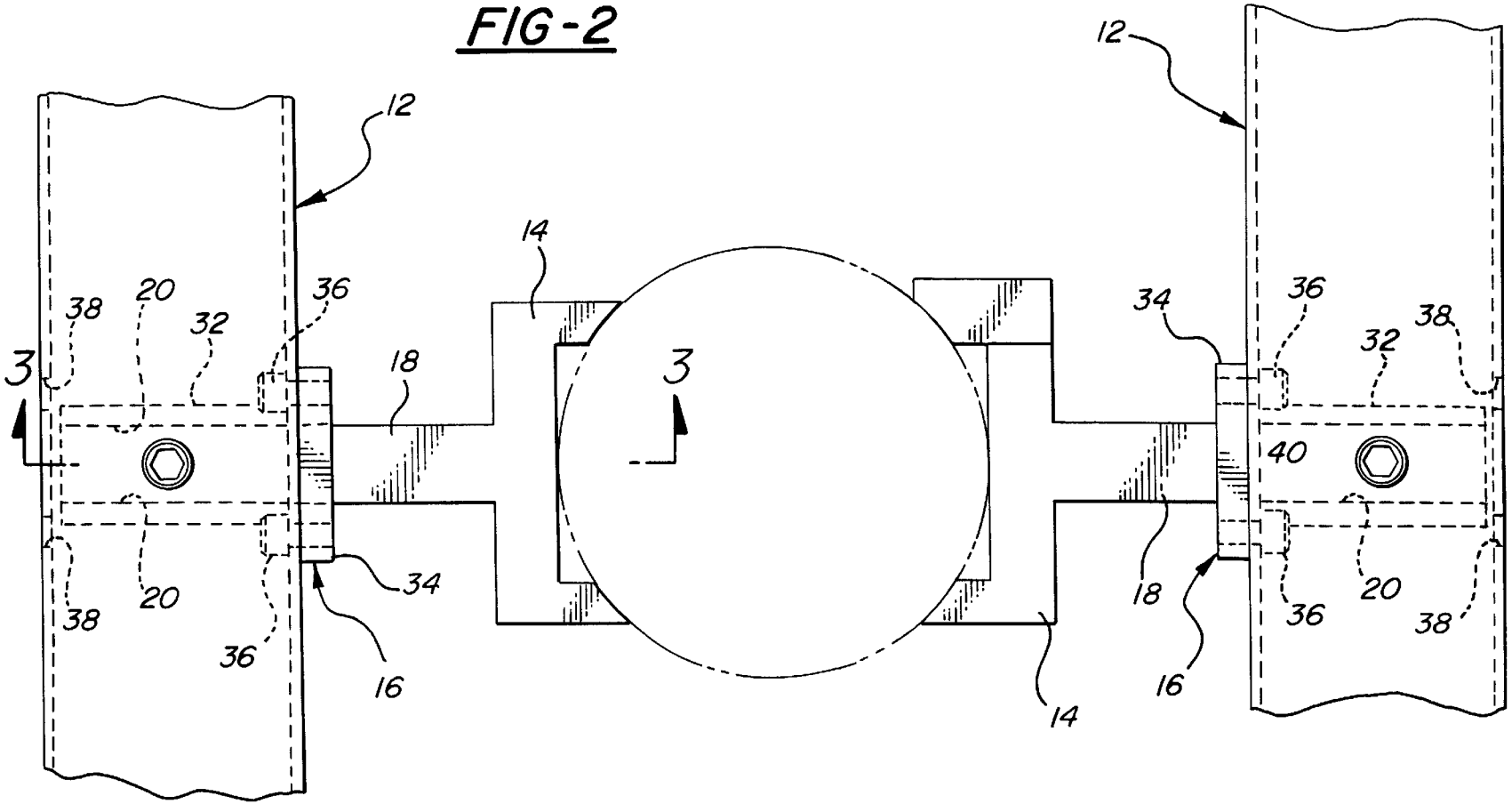
FIG. 2 is a plan view of a pair of spaced transfer bars combined with the subject invention.

Referring to the Figures, wherein like numerals indicate like or corresponding parts throughout the several views, a work piece transfer assembly for a press including a reciprocating member and a series of longitudinally spaced in-line stations wherein each station is a further progression of a work piece forming process is shown in FIG. 1. The transfer assembly is specifically adapted for operation with a press of the type including a reciprocating member, i.e., a ram, and a series of in-line die stations wherein each station is a further progression of the work piece forming process. A plurality of work pieces are shown in phantom in FIG. 1 and singularly in FIG. 2.

The transfer assembly includes a transfer bar, generally indicated at 12, and a motion transmitting mechanism for moving the transfer bar 12 inward, outward, and longitudinally for transferring work pieces through the press. The transfer mechanism may be of the type well known in the art as described in any one of the aforementioned Sofy patents. A finger 14 is attached to the transfer bar 12 for engaging and transferring work pieces through the press.

Figure 3:
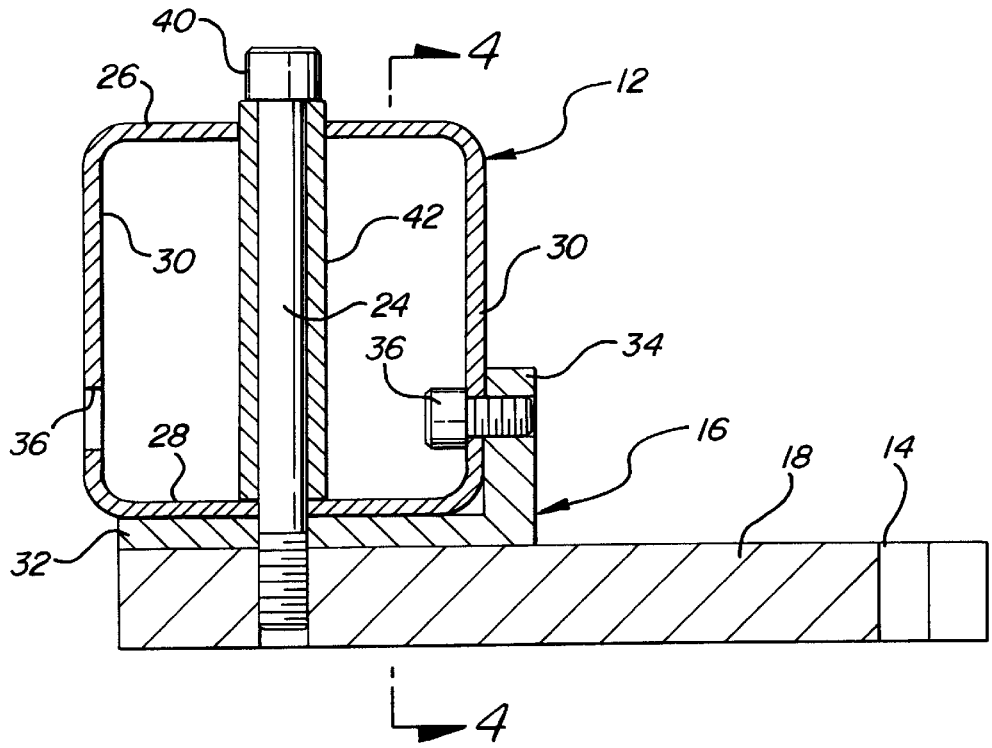
FIG. 3 is a cross sectional view taken along line 3—3 of FIG. 2.
Figure 4:
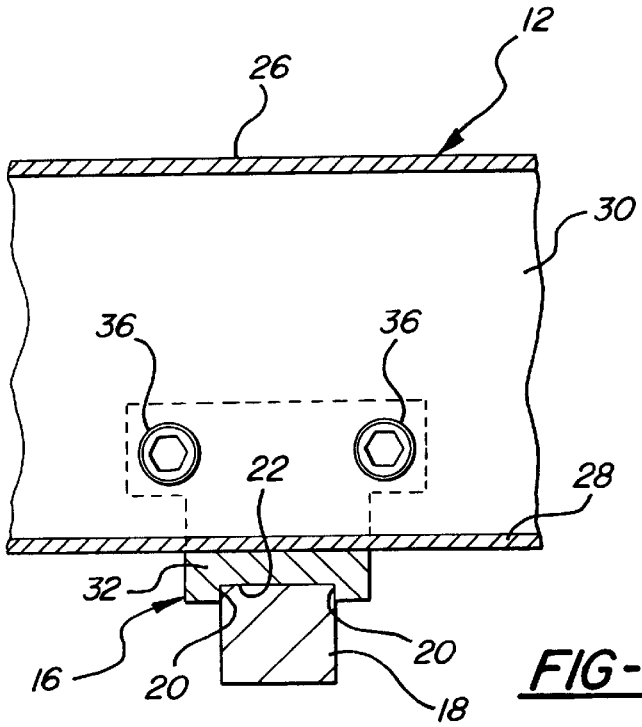
FIG. 4 is a cross sectional view taken along line 4—4 of FIG. 3.

The assembly is characterized by a mounting plate, generally indicated at 16, attaching the finger 14 to the transfer bar 12 to extend in a cantilevered fashion to a distal end, the distal end being forked to engage a work piece. The finger 14 includes a shank 18 which has a four sided cross section. The mounting plate 16 includes abutments defined by the sides 20 of a groove 22 for engaging the shank 18 to prevent the shank 18 from rotating relative to the mounting plate 16. A shank fastener 24 extends downwardly through the transfer bar 12 and the mounting plate 16 to threadedly engage the shank 18 and sandwich the mounting plate 16 between the shank 18 and the transfer bar 12. As best shown in FIGS. 3 & 4, the transfer bar 12 is a hollow tubular member having a top 26 and a bottom 28 interconnected by two sides 30.

The mounting plate 16 is L-shaped with a first leg 32 sandwiched between the bottom 28 of the transfer bar 12 and the shank 18 and with a second leg 34 engaging he side 30 of the transfer bar 12. A pair of horizontally spaced plate fasteners 36 interconnect the second leg 34 and the side 30 of the transfer bar 12 to attach the mounting plate 16 to the transfer bar 12 with the lower, horizontal or first leg 32 engaging the bottom 28 of the transfer bar 12.

As alluded to above, the abutments are defined by the sides 20 of the groove 22 in the mounting plate 16 and the shank 18 has sides in engagement with the sides 20 of the groove 22. This is very close fit to prevent relative lateral movement between the shank 18 and the mounting plate 16.

In order to increase strength, the plate fasteners 36 are spaced apart a distance greater than the distance between the sides of said shank, i.e., the width of the shank 18. In addition, the plate fasteners 36 extend from inside the hollow transfer bar 12 to threadedly engage the inside of the second leg 34 of the mounting plate 16. In order to provide access with a tool to rotate the plate fasteners 36, the transfer bar 12 includes an access hole 38 opposite to each of the plate fasteners 36.

The shank fastener 24 includes a head 40 and a column 42 is disposed inside of the transfer bar 12 and is in compression between the head 40 of the shank fastener 24 and the inside of the bottom 28 of the transfer bar 12. Therefore, the shank fastener 24 clamps together the column 42, the bottom 28 of the transfer bar 14, the first leg 32 of the mounting plate and the shank 18.

The second leg 34 of the mounting plate 16 is T-shaped with the plate fasteners 36 threadedly engaging the top of the T-shape, the groove being disposed in the bottom of the T-shape. In this manner the strength is increased as the plate fasteners 36 are spaced apart a distance greater than the distance between the sides (i.e., the width) of the shank 18 and the shank fastener 24 is disposed horizontally between the plate fasteners 36.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A work piece transfer assembly for a press including a reciprocating member and a series of longitudinally spaced in-line stations wherein each station is a further progression of a work piece forming process, said assembly comprising:

a transfer bar (12) having a bottom (28) and at least one side (30);

a motion transmitting mechanism for moving said bar (12) inward, outward, and longitudinally for transferring work pieces through the press; and a finger (14) attached to said transfer bar (12) for engaging and transferring work pieces through the press, said finger having a shank (18);

said assembly characterized by a mounting plate (16) attaching said finger (14) to said transfer bar (12) to extend in a cantilevered fashion to a distal end;

said mounting plate (16) being L-shaped with a first leg (32) sandwiched between said bottom (28) of said transfer bar (12) and said shank (18) and with a second leg (34) engaging said side (30).

2. An assembly as set forth in claim 1 wherein said first leg (32) of said mounting plate (16) includes abutments for engaging said shank (18) to prevent said shank (18) from rotating relative to said mounting plate (16).

3. An assembly as set forth in claim 2 including a shank fastener (24) extending downwardly through said transfer bar (12) and said mounting plate (16) to threadedly engage said shank (18) and sandwich said mounting plate (16) between said shank 18 and said transfer bar (12).

4. An assembly as set forth in claim 3 including a pair of horizontally spaced plate fasteners (36) interconnecting said second leg (34) and said side (30) of said transfer bar (12) to attach said mounting plate (16) to said transfer bar (12).

5. An assembly as set forth in claim 4 wherein said abutments are defined by the sides (20) of a groove (22) in said mounting plate (16), and said shank (18) has sides in engagement with said sides (20) of said groove (22).

6. An assembly as set forth in claim 4 wherein said plate fasteners (36) are spaced apart a distance greater than the distance between said sides of said shank (18).

7. An assembly as set forth in claim 4 wherein transfer bar (12) is hollow and said plate fasteners (36) extend from inside said transfer bar (12) to threadedly engage said second leg (34) of said mounting plate (16).

8. An assembly as set forth in claim 7 wherein said transfer bar (12) includes an access hole (38) in said transfer bar (12) opposite to each of said plate fasteners (36) for inserting a tool to rotate said plate fasteners (36).

9. An assembly as set forth in claim 4 wherein said transfer bar (12) is hollow and said shank fastener (24) includes a head (40), a column (42) disposed inside of aid transfer bar (12) in compression between said head (40) of said shank fastener 24) and said bottom (28) of said transfer bar (12).

10. An assembly as set forth in claim 9 wherein said plate fasteners (36) are spaced apart a distance greater than the distance between said sides of said shank (18) and said shank fastener (24) is disposed horizontally between said plate fasteners (36).

11. An assembly as set forth in claim 10 wherein said second leg (34) is shaped with said plate fasteners (36) threadedly engaging the top of said T-shape, said groove (22) being disposed in the bottom of said T-shape.

12. A work piece transfer assembly for a press including a reciprocating member and a series of longitudinally spaced in-line stations wherein each station is a further progression of a work piece forming process, said assembly comprising:

a finger (14) adapted for attachment to a transfer bar (12) for engaging and transferring work pieces through a press, said finger having a shank (18);

said assembly characterized by a mounting plate (16) for attaching said finger (14) to the transfer bar (12) to extend in a cantilevered fashion to distal end, said mounting plate (16) being L-shaped with a first leg (32) for being sandwiched between the bottom of the transfer bar (12) and said shank (18) and with a second leg (34) for engaging the side of the transfer bar (12).

13. An assembly as set forth in claim 12 wherein said mounting plate (16) includes abutments for engaging said shank (18) to prevent said shank (18) from rotating relative to said mounting plate (16).

14. An assembly as set forth in claim 13 including a shank fastener (24) for extending downwardly through the transfer bar (12) and said mounting plate (16) to threadedly engage said shank (18) and sandwich said mounting plate (16) between said shank 18 and the transfer bar (12).

15. An assembly as set forth in claim 14 wherein said abutments are defined by the sides (20) of a groove (22) in said mounting plate (16), and said shank (18) having sides in engagement with said sides (20) of said groove (22).

16. An assembly as set forth in claim 15 wherein said second leg (34) is T-shaped with said plate fasteners (36) threadedly engaging the top of said T-shape and said groove (22) being disposed in the bottom of said T-shape.

* * * * *